US009981771B2

(12) United States Patent
Noskin et al.

(10) Patent No.: US 9,981,771 B2
(45) Date of Patent: May 29, 2018

(54) INTEGRATED PLATFORM AND FOLDING CARTON TRAY

(71) Applicant: ELC Management LLC, Melvillle, NY (US)

(72) Inventors: Kenneth Noskin, New York, NY (US); Sergio Cruz, Jersey City, NJ (US)

(73) Assignee: ELC MANAGEMENT LLC, Melville, NY (US)

( * ) Notice: Subject to any disclaimer, the term of this patent is extended or adjusted under 35 U.S.C. 154(b) by 196 days.

(21) Appl. No.: 15/168,679

(22) Filed: May 31, 2016

(65) Prior Publication Data

US 2017/0341804 A1 Nov. 30, 2017

(51) Int. Cl.
*B65D 5/50* (2006.01)
*B65D 5/24* (2006.01)

(52) U.S. Cl.
CPC ..... *B65D 5/503* (2013.01); *B65D 5/248* (2013.01)

(58) Field of Classification Search
CPC ..... B65D 5/503; B65D 5/248; B65D 5/5088; B65D 5/4266; B65D 5/22; B65D 5/241; B65D 1/36
USPC ..... 206/565, 583
See application file for complete search history.

(56) References Cited

U.S. PATENT DOCUMENTS 3,899,119 A 8/1975 Roccaforte
6,527,168 B1 * 3/2003 Robinson ..... B65D 5/248 229/136
6,581,777 B2 * 6/2003 Thibault ..... B65D 5/5026 206/470
7,044,359 B1 * 5/2006 Cohen ..... B65D 5/248 229/122.34
7,331,465 B2 * 2/2008 Parrington ..... B65D 77/003 206/583
8,028,836 B2 * 10/2011 Bacon ..... B65D 5/0045 206/386
8,066,178 B2 11/2011 Sorrentino et al.
8,528,806 B2 9/2013 Sorrentino et al.
8,727,123 B1 * 5/2014 Roberts ..... B65D 81/075 206/521
2003/0116468 A1 * 6/2003 Schwester ..... B65D 5/503 206/592
2007/0193922 A1 * 8/2007 Bacon ..... B65D 5/4204 206/776
2007/0235513 A1 * 10/2007 Mazurek ..... B65D 5/248 229/125.19
2008/0223911 A1 * 9/2008 Mazurek ..... B65D 5/248 229/122.32
2013/0062400 A1 3/2013 Meyer et al.
2013/0270133 A1 10/2013 Kenner et al.
2015/0321783 A1 11/2015 Kenner et al.

* cited by examiner

*Primary Examiner* — Steven A. Reynolds
(74) *Attorney, Agent, or Firm* — Peter Giancana

(57) ABSTRACT

An integrated carton and liner assembly for consumer products includes a paperboard tray and thermoformed plastic insert. The sidewalls of the assembled carton are four layers thick, interleaved, and secured with snap fitments for exceptional sturdiness. The assembly is easy to assemble without adhesive, and achieves an upscale look. The thermoform liner is held securely in the carton.

7 Claims, 8 Drawing Sheets

INTEGRATED PLATFORM AND FOLDING CARTON TRAY

FIELD OF THE INVENTION

The invention is in the field of folding cartons for packaging consumer products. More specifically, the invention pertains to tray-style folding cartons that have a plastic platform disposed therein.

BACKGROUND

It is well known to package consumer products in a custom molded plastic insert, also known as a platform, which is disposed in a tray-style paperboard folding carton. The platform is typically thermoformed with one or more cavities that are shaped to match the contour of products that will be disposed in the cavities. The platform can be made to fit snugly within the folding carton to limit movement of the platform. Adhesive may also be used for this purpose. If the folding carton does not have an attached cover, then a separate cover or shrink wrap may be used to secure the whole assembly, or the assembly may be disposed in a sleeve or box. Because the packaged products are reposed in complimentarily shaped cavities, the products experience very little movement with respect to the platform. This protects the products during distribution. Also, the custom molded platform creates an upscale look and feel for the consumer products.

Various designs for paperboard folding cartons are known. For example, the website (http://www.since 1878.com/folding-carton-styles.php?pageNum_Recordset_CartonStyles=0&total Rows_Recordset_CartonStyles=42) of The New York Label & Boxworks company displays at least twenty paperboard folding cartons in the tray style (i.e. without an attached cover). The simplest designs have single thickness side walls that are held in place by adhesive or interlocking tabs (FIGS. 1 and 2). Other designs have sidewalls that are folded over on themselves, giving a double thickness of paperboard for strength (FIG. 3). Again, the folded over portions may be secured with adhesive and/or interlocking tabs. Cartons having side walls that comprise three layers of paperboard are also known (see U.S. Pat. No. 7,044,359). Certain cartons, such as the so-called frame view (FIG. 4) and shadowboxes (FIG. 5), offer a more upscale appearance which is advantageous in the marketplace. Into any of these tray-style folding cartons, a custom platform may be disposed, but the side walls of the folding carton are secured before the platform is put into the carton. So, unless some feature is provided, the platform can be easily or unintentionally removed from the fully assembled folding carton without disassembling the carton. Also, whenever adhesive is used, there is always a chance of adhesive failure (due to temperature extremes or time), which would render a carton unusable.

A custom platform and tray-style folding carton assembly that has sidewalls comprised of four layers of paperboard and plastic, that are held together without adhesive, and that is available in simple or upscale styles, would offer significant advantages over conventional designs.

OBJECT OF THE INVENTION

A main object of the invention is to provide an custom platform and folding carton assembly for consumer products, such as cosmetic or personal care products, which sidewalls are four layers thick, that is easy to assemble without adhesive, and that achieves an upscale look.

SUMMARY OF THE INVENTION

The objects of the invention are met by an integrated platform and folding carton assembly that comprises a tray-style paperboard folding carton and a thermoformed plastic platform as described herein. The sidewalls of the assembly are four layers thick, interleaved, and secured with snap fitments for exceptional sturdiness.

DETAILED DESCRIPTION

An integrated platform and folding carton assembly (50) according to the present invention comprises a paperboard folding carton (1) which is formed from a blank (i.e. a flat template), and a thermoformed (or otherwise molded) plastic insert (21). In the figures, the platform and folding carton are depicted as rectangular, however, the principles of the present invention may be embodied in shapes other than rectangular. For example, platforms and folding cartons according to the invention will have a number of sides, N, where N is at least three. Typical may be platforms and folding cartons having from three to eight sides, although platforms and folding cartons having more than eight sides are also possible.

The Folding Carton

Figure 6:
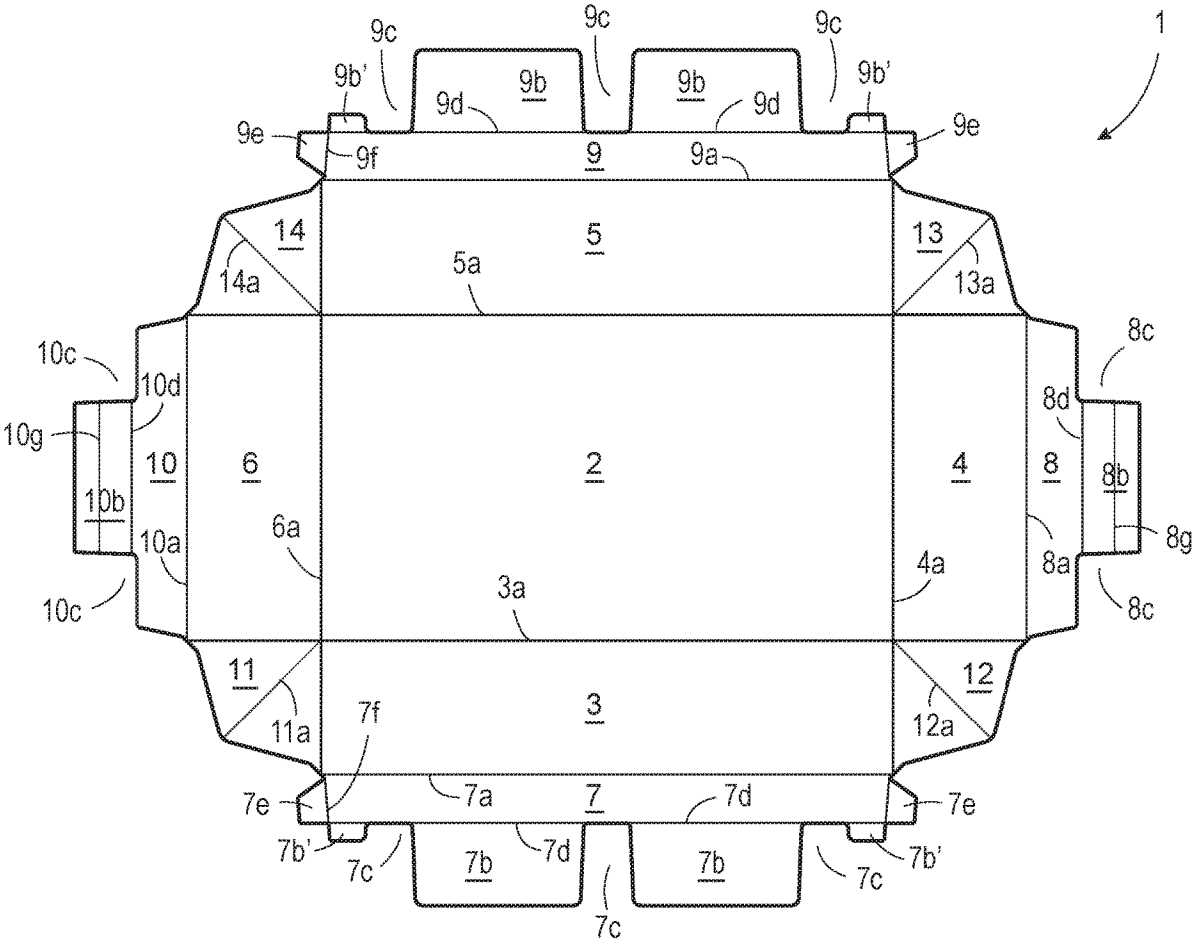
FIG. 6 depicts a paperboard blank according to the invention.

A tray-style folding carton (1) according to the invention is formed from a unitary paperboard blank which must be folded in a specific order. One preferred embodiment of such a blank is shown in FIG. 6. The paperboard blank comprises a rectangular (N=4) bottom surface (2). Depending from each lateral edge of the rectangular bottom surface is a rectangular side wall (3, 4, 5, 6), and depending from each of the four side walls is a flap (7, 8, 9, 10), for a total of four flaps. In between the bottom surface (2) and each side wall is a fold line (3*a*, 4*a*, 5*a*, 6*a*). Likewise, in between each side wall and flap is a fold line (7*a*, 8*a*, 9*a*, 10*a*). From the flat configuration shown in FIG. 6, the side walls (3, 4, 5, 6) will be folded along the fold lines (3*a*, 4*a*, 5*a*, 6*a*) approximately 90°, to create upright side walls, while the flaps will be folded along fold lines (7*a*, 8*a*, 9*a*, 10*a*) approximately 180° to lie face to face with the side walls. The side walls are all the same height. The flaps may be all the same height or some may be different, but the height of the flaps must be less than the height of the side walls.

Each flap has one or more tabs (7*b*, 7*b*', 8*b*, 9*b*, 9*b*', 10*b*) that are bordered by one or more reduced width sections (7*c*, 8*c*, 9*c*, 10*c*) of the flap. As shown in FIG. 6, those tabs (7*b*', 9*b*') near the ends of the long flaps (7, 9) may be much smaller than the other tabs. Preferably, the tabs are bordered by fold lines (7*d*, 8*d*, 9*d*, 10*d*), as shown. Optionally, some or all of the tabs have a fold line (8*g*, 10*g*) that runs through the tab.

Each flap may have one or two end tabs depending from the short sides of the flaps, but there will only be a total of four end tabs. For example, in FIG. 6, each of the long side flaps (7, 9) has an end tabs (7*e*, 9*e*) at each end, bordered by a fold line (7*f*, 9*f*). Preferably, each side wall is connected to its two adjacent side walls by a gusset (11, 12, 13, 14). Each gusset is divided by a fold line (11*a*, 12*a*, 13*a*, 14*a*) that runs diagonally from each corner of the bottom surface (2), whereby each gusset may be folded into two congruent triangles.

The Platform (Plastic Insert)

The platform (21) may typically be made out of PET or styrene, but other plastics may also be suitable. The platform comprises a top surface (22) that has as many lateral edges as the bottom surface (2) of the folding carton (1), i.e. N. One preferred embodiment of a custom platform according to the invention is shown in FIGS. 7A-7D. There, the platform (21) comprises a rectangular top surface (22) that has four lateral edges. One or more cavities (22*a*) in the top surface are designed to hold packaged products. Preferably, the cavities are shaped to match the contour of the products, so that the products experience very little movement with respect to the platform. This protects the products during distribution. Depending at an approximately 90° angle from each lateral edge of the top surface is a rectangular side wall (23, 24, 25, 26). Each side wall has a top and bottom edge. Reference numerals (23*a*, 24*a*, 25*a*, 26*a*) depict the joining of the top edges of the side walls to the lateral edges of the top surface (22). Preferably, this joining is rigid and does not allow folding between the top surface and the sidewalls. Preferably, the lateral edges of the side walls are joined to each other, so that the top surface and side walls form one rigid construction. The bottom edges of the side walls form a rectangular base of the platform.

Figure 7A:
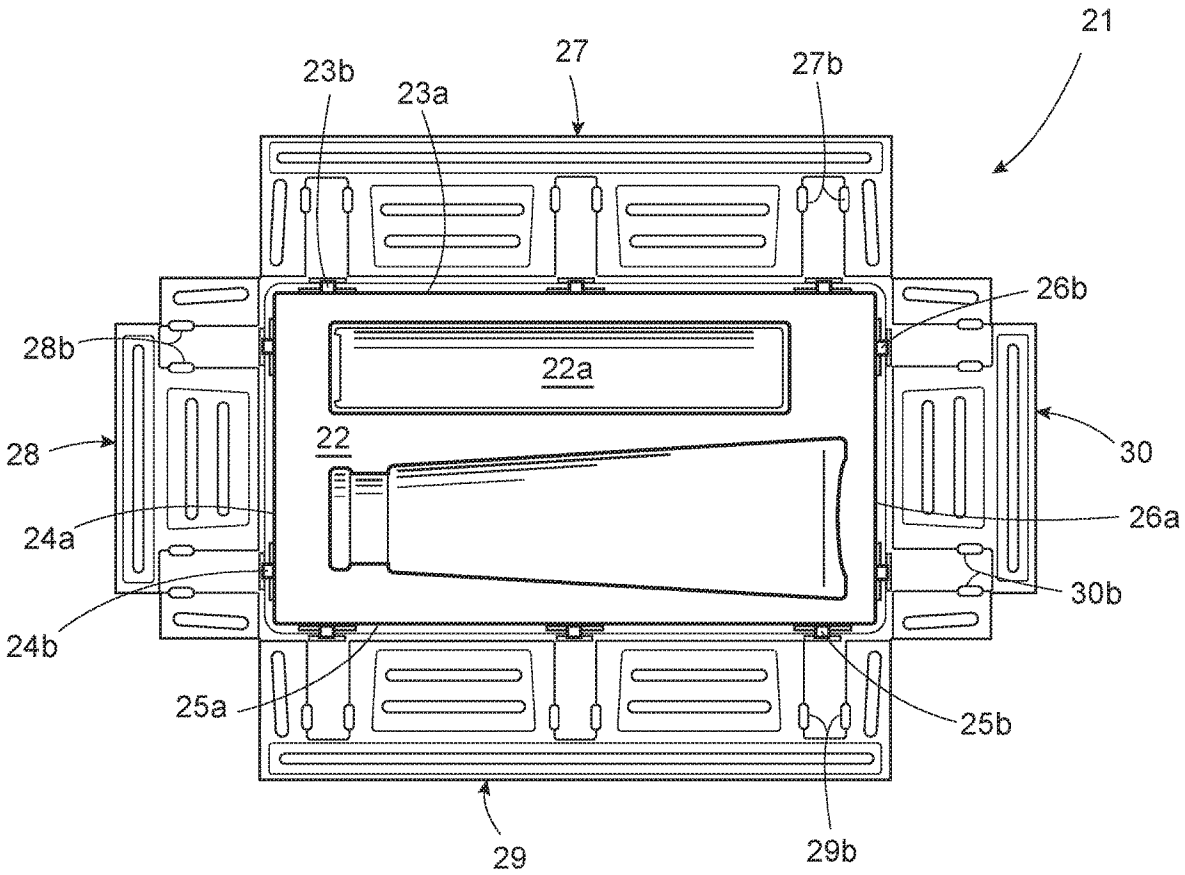
FIGS. 7A-7D depict a plastic platform insert according to the invention.
Figure 7B:
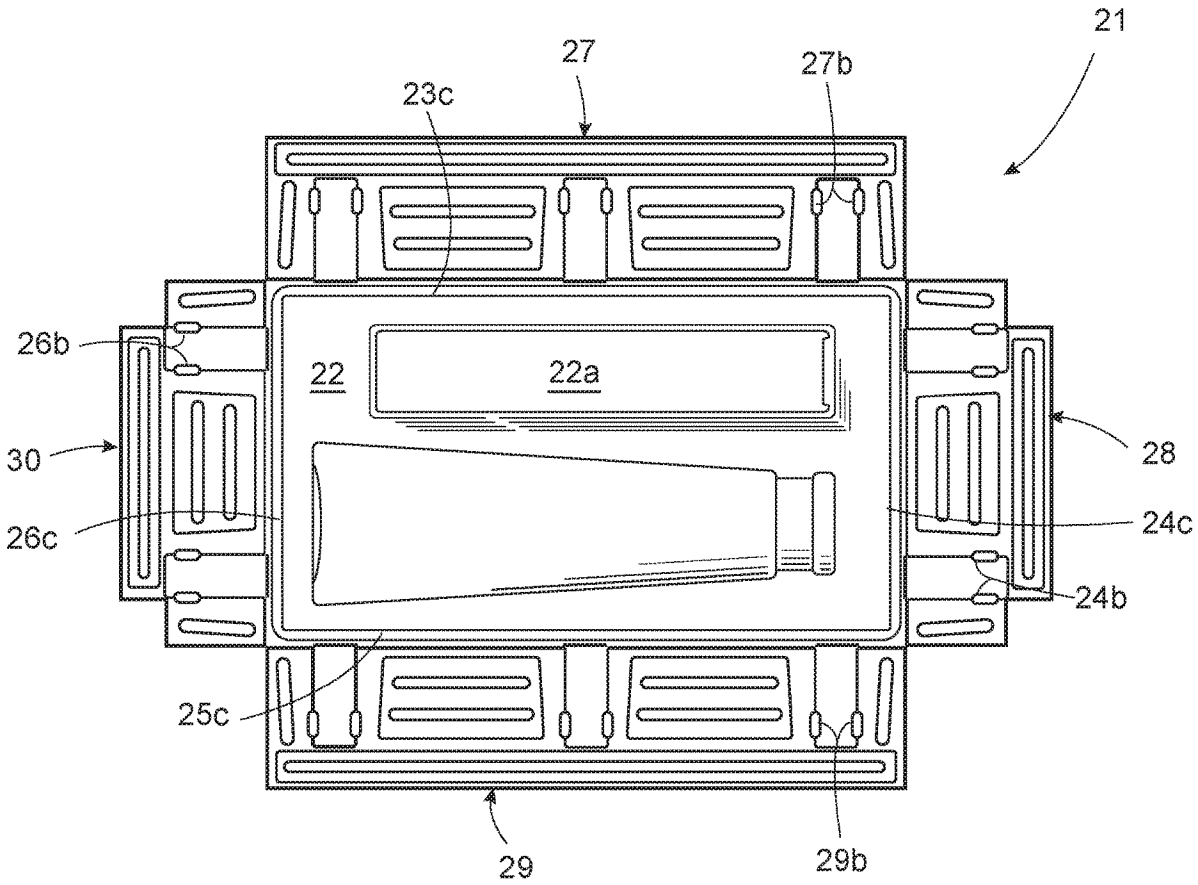

Depending from each bottom edge of the side walls (23, 24, 25, 26) of the platform (21) is a flap (27, 28, 29, 30), for a total of four flaps. In FIG. 7B, reference numerals (23*c*, 24*c*, 25*c*, 26*c*) depict fold lines between the bottom edges of the side walls and the flaps. These fold lines are designed to allow the flaps to fold or rotate upward so that each flap is face to face with a side wall. Preferably, the side walls of the platform are all the same height. The flaps of the platform may be all the same height or some may be different, but the height of the flaps of the platform must be less than the height of the side walls (3,4,5,6) of the folding carton (1).

Figure 7C:
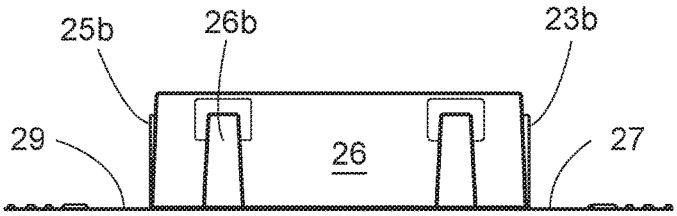
Figure 7D:
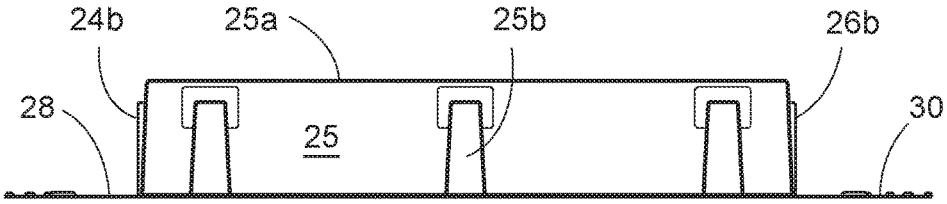

Means are provide to hold the flaps (27, 28, 29, 30) in the upright position, and fasten the flaps to the side walls (23, 24, 25, 26). For example, FIGS. 7A, 7C and 7D depict a snap fitment. Each side wall of the platform (21) is provided with one or more first portions of a snap fitment, such as protruding members (23*b*, 24*b*, 25*b*, 26*b*). Each protruding member is a little wider at the front than at the back. Also referring to FIG. 7A, each flap of the insert is provided with one or more second portions of a snap fitment, such as sets of two protruding ribs (27*b*, 28*b*, 29*b*, 30*b*). When the flaps are foldup up, the one or more first and second portions engage each other and hold the flaps (27, 28, 29, 30) in the upright position. For example, each set of two ribs flexes slightly as it is forced around a wider portion of the protruding member. Once the two ribs are passed the wider portion of the protruding member, the flap is held in an upright position. Each side wall and flap may have as many protruding members and sets of ribs as are needed to fasten the flaps securely to the side walls. For example, in FIGS. 7A-7D, the short side walls have two protruding members and the short flaps have two sets of ribs; the long side walls have three protruding members and the long flaps have three sets of ribs. Preferably, every side wall has at least two protruding members and every flap has at least two sets of ribs.

Assembling the Folding Carton and Platform

Unlike many conventional paperboard trays with plastic inserts, the paperboard carton and platform of the present invention must be folded simultaneously. When assembled, the flaps (27, 28, 29, 30) of the molded platform (21) will be positioned between the sidewalls (3, 4, 5, 6) and flaps (7, 8, 9, 10) of the folding carton (1). Also, the flaps (7, 8, 9, 10) of the folding carton will be positioned between the sidewalls (23, 24, 25, 26) and flaps (27, 28, 29, 30) of the platform. As a result, the sidewalls of the finished assembly will be four layers thick (see FIG. 15).

Figure 8:
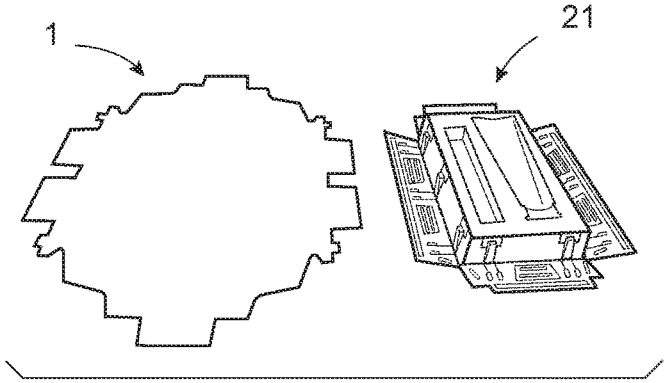
FIGS. 8-14 show steps in the assembly of the folding carton and platform.

FIG. 8, shows a die-cut blank for a tray-style paperboard folding carton (1), and a thermoformed platform (21) prior to assembly. FIGS. 9-14 show the carton and platform in various stages of assembly. First, the platform is centered on the paperboard blank, with the flaps (27, 28, 29, 30) of the platform lying on top of the side walls (3, 4, 5, 6) of the blank.

Figure 9:
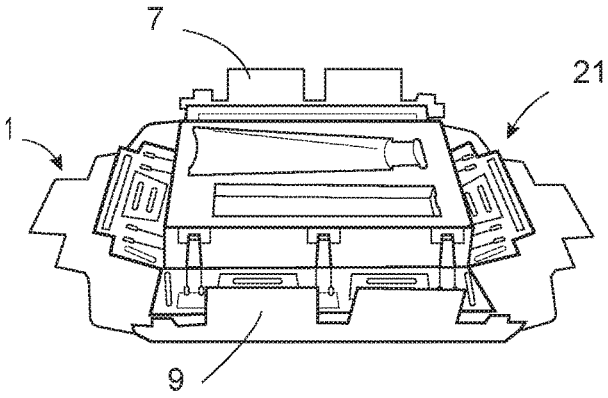
Figure 10:
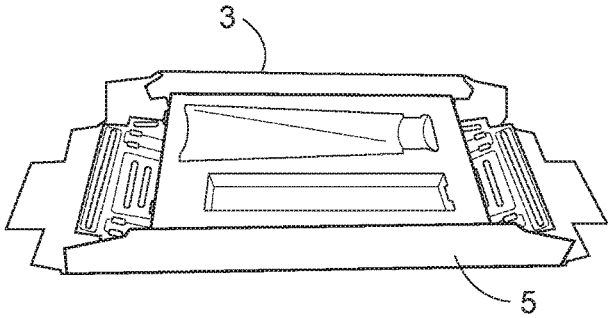

Referring to FIG. 9, the long flaps (7, 9) of the blank are folded over, approximately 180°, along the fold lines (7*a*, 9*a*), so that the long flaps of the folding carton lie on top of the long flaps (27, 29) of the platform. The first portions of the snap fitments (i.e. ribs 27*b*, 29*b*) are positioned in the reduced width sections (7*c*, 9*c*) of the long flaps (7, 9) of the blank, so that they are not covered. Next, the long side walls (3, 5) of the blank and the long flaps (27, 29) of the platform are folded upward simultaneously, along fold lines (3*a*, 5*a*) and (23*c*, 25*c*), respectively. When the long flaps (27, 29) of the platform are folded approximately 90°, the first portions of the snap fitments (i.e. ribs 27*b*. 29*b*) pass through the long flaps of the folding carton to engage the second portions of the snap fitments (i.e. protruding members 23*b*, 25*b*) of the long side walls (23, 25) of the platform, which will cause the long side walls of the folding carton and platform, to remain upright, as in FIG. 10. No adhesive is needed to hold the long flaps of the carton in place.

Figure 11:
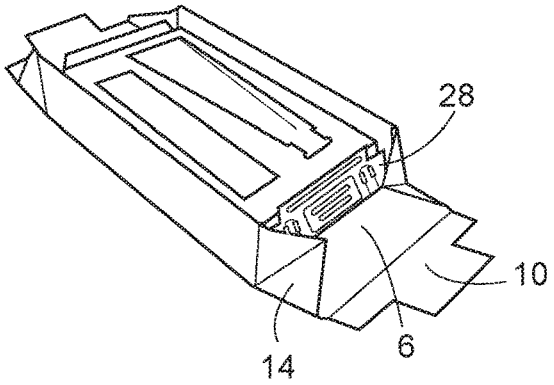

In FIG. 11, the short flaps (28, 30) of the platform (21) are folded upward and snapped in place using the ribs (28*b*, 30*b*) and protruding members (24*b* and 26*b*) of the platform. Next, the gussets (11, 12, 13, 14) of the folding carton (1) are folded along the diagonal fold lines (11*a*, 12*a*, 13*a*, 14*a*), as shown.

Figure 12:
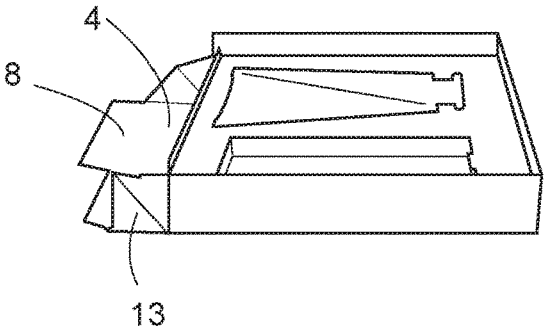
Figure 13:
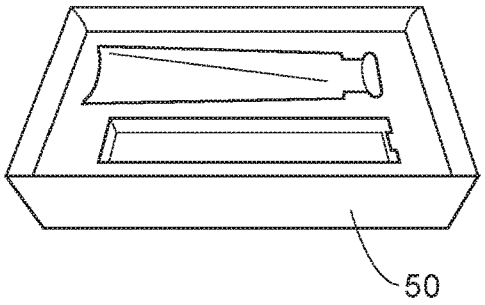

The short side walls (4, 6) of the blank are then folded upward partially, collapsing each gusset against the platform. The short flaps (8, 10) are partially folded along fold lines (8*a*, 10*a*), and the tabs (8*b*, 10*b*) are partially folded along fold lines (8*d*, 10*d*). Then, as each short side wall (4, 6) is folded upward the rest of the way, each tab (8*b*,10*b*) must be guided in between the short flap (28, 30) and the side wall (24, 26) of the platform (21). When one short side is fully inserted, the construction is represented by FIG. 12. When both short sides are assembled, the construction is represented by FIG. 13. Similar to the long flaps of the carton, each short flap of the carton is held between a short flap and side wall of the platform, so no adhesive is needed to hold the short flaps of the carton in place.

Figure 14:
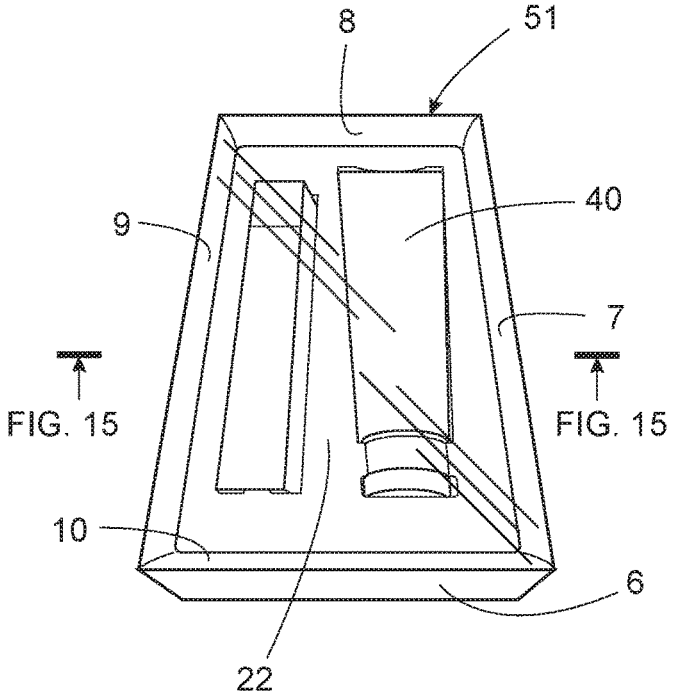

Products (40) are then packaged into the one or more cavities (22*a*) in the top surface (22) of the platform (21). As shown in FIG. 14, the top surface (22) of the platform (21) is lower than the side walls (3, 4, 5, 6) of the tray-style folding carton (1). This degree of recess may be easily varied by considering the relative heights of the platform side walls (23, 24, 25, 26) and the folding carton side walls (3, 4, 5, 6). When those heights are the same or nearly so, then the top surface of the platform is flush with side walls of the folding carton. Technically, it is even possible for the platform to be higher than the sidewalls of the folding carton.

Figure 1:
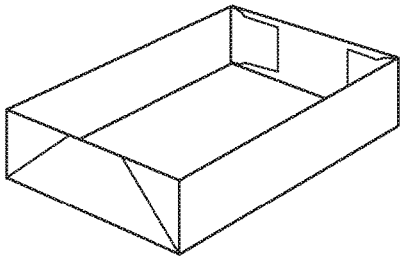
Prior Art FIG. 1
FIGS. 1-5 depict some styles of folding cartons known in the prior art.
Figure 2:
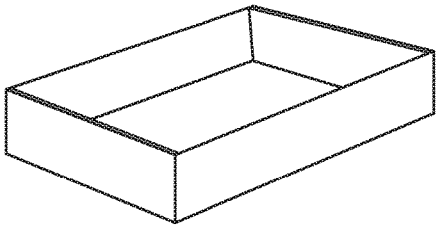
Figure 3:
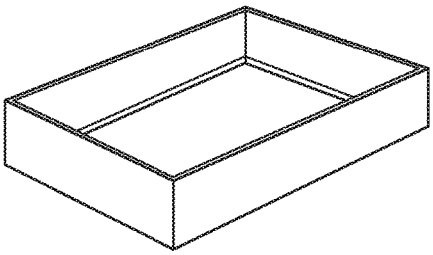
Figure 4:
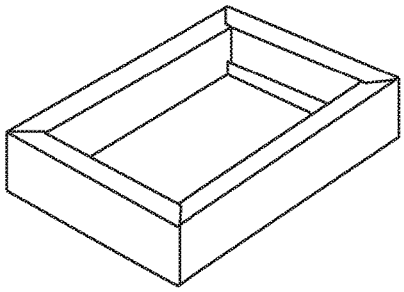
Figure 5:
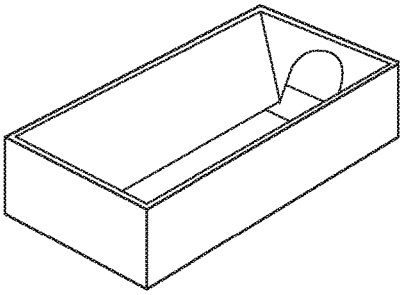

Furthermore, in FIG. 14, the flaps (7, 8, 9, 10) of the tray-style folding carton angle down and inward. This gives the finished assembly a beveled and recessed look, which is more elegant than a simple plastic insert placed loosely in a conventional carton. However, the beveled look can be avoided by eliminating the fold lines (7*d*, 8*d*, 9*d*, 10*d*) of the folding carton. For the straight fold-over look the dimensions of the bottom surface (2) of the folding carton should closely match the dimensions of the base of the platform (which is formed by the bottom edges 23*c*, 24*c*, 25*c*, 26*c*), the bottom of the folding carton being just slightly larger in length and width. Alternatively, when the desired look is a so-called frame view (FIG. 4), then the dimensions of the bottom surface (2) of the folding carton must be larger than the dimensions of the base of the platform in length and width. For example, if the thickness of the frame is to be 2 cm, then the length and width of the bottom surface of the folding carton should be 4 cm greater than the length and width of the base of the platform.

The assembled, integrated carton may be closed with a paperboard or plastic cover (51) that is clear, translucent or opaque. A so-called windowed cover may also be used. Alternatively, the whole assembly may be disposed in a sleeve or box, or the construction can be shrink-wrapped.

Figure 15:
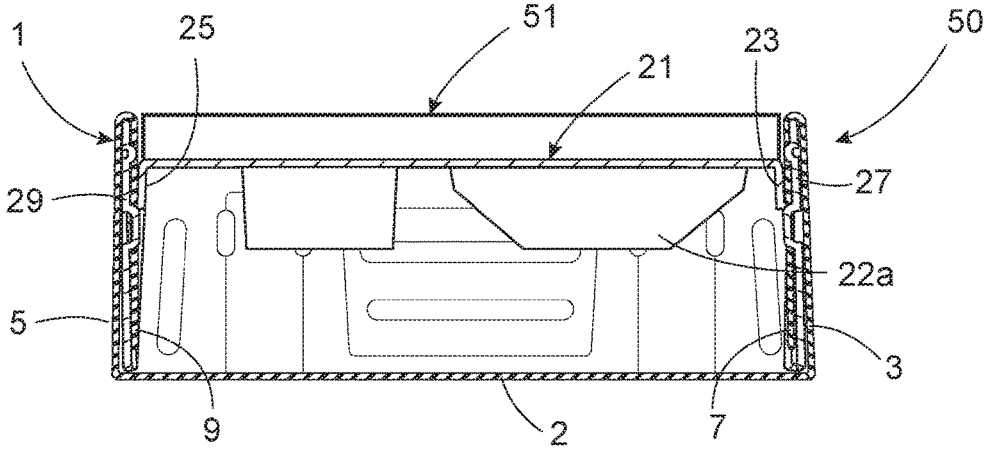
FIG. 15 shows a cross sectional view of the assembled, integrated folding carton, the sidewalls of which have four layers.

FIG. 15 is a cross sectional view that shows the layers that make up the side walls of the assembled construction. Referring to the left side of FIG. 15, we can see that the sidewall of the assembled construction comprise the sidewall (5) of the folding carton (1), the flap (29) of the molded platform (21), the flap (9) of the folding carton, and the sidewall (25) of the molded platform. All of the sidewalls are similarly constructed. Thus, the sidewalls of the assembled, integrated carton (50) are four layers thick, interleaved, and secured with snap fitments. This makes the carton exceptionally sturdy, even for a relatively lightweight paperboard and/or relatively thin-walled plastic tray. Thus, a significant cost savings can be realized in materials. The plastic insert cannot come out of the paperboard tray unintentionally. The integrated carton is easy to assemble manually, and can be automated. No adhesive is needed, which saves cost. The carton is fully recyclable. If disposal ordinances require it, the paperboard and plastic insert can be easily separated by unsnapping the protruding ribs (27*b*, 28*b*, 29*b*, 30*b*) from the protruding members (23*b*, 24*b*, 25*b* 26*b*).

What we claim is:

1. An integrated platform and folding carton assembly that comprises:

a unitary folding carton that has a bottom surface, sidewalls and flaps, wherein each sidewall is connected to the bottom surface along a first fold line and connected to one of the carton flaps along a second fold line; and a platform that has a top surface, sidewalls and flaps, wherein each sidewall is connected to the top surface and connected to one of the platform flaps along a fold line; wherein the flaps of the platform are positioned between the sidewalls and flaps of the folding carton, and the flaps of the folding carton are positioned between the sidewalls and flaps of the platform, so that the sidewalls of the assembly have four layers.

2. The integrated platform and folding carton of claim 1 wherein the number of sidewalls of the folding carton is from 3 to 8 and the number of sidewalls of the platform is from 3 to 8.

3. The integrated platform and folding carton of claim 1 wherein the flaps of the platform are fastened to the sidewalls of the platform to hold the flaps of the platform in an upright position.

4. The integrated platform and folding carton of claim 1 wherein adjacent side walls of the carton are connected by a gusset that is folded into two congruent triangles.

5. The integrated platform and folding carton of claim 1 wherein the folding carton is paperboard and the platform is thermoformed plastic.

6. An integrated platform and folding carton that comprises:

a unitary folding carton comprising:

a bottom surface that has N lateral edges;

N rectangular side walls, each side wall of the carton having:

a bottom edge that joins to a lateral edge of the bottom surface along fold lines that allow the side walls to rotate 90° with respect to the bottom surface;

two lateral edges; and a top edge;

N flaps that depend from the top edges of the rectangular side walls of the carton along fold lines that allow the flaps to rotate 180° so that each flap is face to face with a rectangular side wall of the folding carton, each flap of the carton having one or more tabs that are bordered by one or more reduced width sections; and a platform comprising:

a top surface that has N lateral edges, and one or more cavities;

N rectangular side walls, each side wall of the platform having:

a top edge that joins to a lateral edge of the top surface;

two lateral edges that join to the lateral edges of adjacent side walls;

a bottom edge; and one or more first portions of a snap fitment;

N flaps that depend from the bottom edges of the rectangular side walls of the platform along fold lines that allow the flaps to rotate upward so that each flap is face to face with a rectangular side wall of the platform, each flap of the platform having one or more second portions of a snap fitment;

wherein the flaps of the platform are disposed between the flaps and sidewalls of the folding carton, and the one or more first and second portions of the snap fitments engage each other through the reduced width sections of the folding carton.

7. The integrated platform and folding carton of claim 6 wherein:

each of the one or more second portions of the snap fitment comprises two protruding ribs; and each of the one or more first portions of the snap fitment comprises a protruding member that has a wider portion that is forced between the two protruding ribs.

* * * * *